US007062361B1

(12) United States Patent
Lane

(10) Patent No.: US 7,062,361 B1
(45) Date of Patent: Jun. 13, 2006

(54) METHOD AND APPARATUS FOR CONTROLLING POWER CONSUMPTION

(75) Inventor: Mark E. Lane, 5715 E. Emerald Oaks Dr., Acworth, GA (US) 30102

(73) Assignee: Mark E. Lane, Acworth, GA (US)

( * ) Notice: Subject to any disclaimer, the term of this patent is extended or adjusted under 35 U.S.C. 154(b) by 0 days.

(21) Appl. No.: 09/563,772

(22) Filed: May 2, 2000

(51) Int. Cl.
*G06F 19/00* (2006.01)

(52) U.S. Cl. ..... 700/295; 700/291; 705/408

(58) Field of Classification Search ..... 700/286, 700/291, 295, 297, 28, 29, 32, 33; 705/412, 705/408; 62/80, 536; 702/61
See application file for complete search history.

(56) References Cited

U.S. PATENT DOCUMENTS

| | | | | | |
|---|---|---|---|---|---|
| 3,343,151 | A | | 9/1967 | Brown et al. | 307/34 |
| 4,075,699 | A | | 2/1978 | Schneider et al. | 705/412 |
| 4,184,340 | A | | 1/1980 | Laughlin et al. | 700/291 |
| 4,216,384 | A | | 8/1980 | Hurley | 307/39 |
| 4,337,401 | A | | 6/1982 | Olson | 700/395 |
| 4,646,528 | A | * | 3/1987 | Marcade et al. | 62/127 |
| 4,916,328 | A | | 4/1990 | Culp, III | 700/291 |
| 5,237,507 | A | | 8/1993 | Chasek | 705/412 |
| 5,414,640 | A | | 5/1995 | Seem | 700/291 |
| 5,543,667 | A | | 8/1996 | Shavit et al. | 700/296 |
| 5,598,349 | A | | 1/1997 | Elliason et al. | 705/412 |
| 5,644,173 | A | | 7/1997 | Elliason et al. | 307/34 |
| 5,696,695 | A | * | 12/1997 | Ehlers et al. | 700/286 |
| 5,894,422 | A | | 4/1999 | Chasek | 700/291 |
| 5,924,486 | A | * | 7/1999 | Ehlers et al. | 165/238 |
| 5,930,773 | A | | 7/1999 | Crooks et al. | 705/30 |
| 5,974,403 | A | | 10/1999 | Takriti et al. | 705/412 |
| 6,018,956 | A | | 2/2000 | Sakata et al. | 62/126 |
| 6,021,402 | A | | 2/2000 | Takriti | 700/28 |
| 6,047,274 | A | | 4/2000 | Johnson et al. | 705/412 |
| 6,157,874 | A | * | 12/2000 | Cooley et al. | 700/295 |
| 6,185,483 | B1 | * | 2/2001 | Drees | 700/295 |
| 6,311,105 | B1 | * | 10/2001 | Budike, Jr. | 700/291 |
| 6,502,409 | B1 | * | 1/2003 | Gatling et al. | 62/80 |
| 6,529,839 | B1 | * | 3/2003 | Uggerud et al. | 702/61 |

* cited by examiner

*Primary Examiner*—Kidest Bahta

(57) ABSTRACT

A method and apparatus for controlling power consumption of a facility, building or simply a collection of one or more devices, by load shedding when power consumption is above, or is predicted to be above, a preselected setpoint, but only if electrical power on the spot market cannot be purchased at or below a preselected price. The apparatus and method of the invention optimizes power usage by taking advantage of the buying of electricity as a commodity on the spot market. As a further aspect of the invention, in the situation of a supermarket for example, which refrigerates food products, artificial product core temperature sensors or direct insertion product sensors can be used to continuously monitor the refrigerated temperature of perishable products. A controller would constantly monitor these temperatures to allow a precise load shedding routine to be implemented.

12 Claims, 4 Drawing Sheets

METHOD AND APPARATUS FOR CONTROLLING POWER CONSUMPTION

TECHNICAL FIELD OF THE INVENTION

The present invention relates to controlling power consumption of a plurality of devices to minimize overall energy costs, by load shedding. Particularly, the present invention relates to controlling a load shedding routing using as a data input a price of electrical power.

BACKGROUND OF THE INVENTION

In today's regulated environment, power utility companies charge consumers or end users according to a policy that encourages energy conservation and assesses the cost for acquiring and maintaining extra power generating equipment to meet peak demands against those end users who create the peak demand. Accordingly, power utilities will typically charge customers for electricity at a first rate for electricity consumed below a first predetermined level, and at a second rate for electricity consumed between the first predetermined level and a second predetermined level. If electrical power consumption exceeds the second predetermined level, a penalty or surcharge is charged to the end user. This surcharge accounts for the fact that the utility had to acquire and maintain extra power generating equipment to meet those periods of unusually high or peak demands.

In order to avoid peak demand charges imposed by the power utility, power end users have employed automatic control systems which monitor power consumption within their facilities and then modify the on/off status of power consuming loads within the facility to maintain power consumption below a predetermined value or setpoint. These systems have typically taken the form of add/shed control systems. The systems are designed to shed loads as power consumption approaches a predetermined level or setpoint which is chosen by the end user. As power consumption begins to fall away from this setpoint, previously shed loads can be added back to operational status so that it may be turned on and utilized by the and user.

There are different types of add/shed control systems. A more common type of add/shed control system establishes a prioritized load order wherein the load having lowest priority will be shed first and the load having highest priority will be shed last. In such a system, if loads can be added back online, the load having the highest priority will be added first and the load having the lowest priority will be added last.

Today's energy saving and cost reducing strategies typically control a building's power consumption based on a programmed setpoint. This type of strategy uses a electrical load shedding setpoint. When the current electrical consumption reaches that setpoint, or is forecast to reach that setpoint, an electronic controller starts reducing electrical loads until the current power consumption is maintained below the setpoint. This type of strategy works well for reducing total kW (kilowatt) consumption and reducing peak demand.

There are many types of strategies as to what loads are shed during this power reduction mode. For example, in offices, the strategy may allow the temperature in the building to rise a few degrees, or in a supermarket, the strategy may drop off some lighting and refrigeration loads. No matter which strategy is used, the basic controlling factor is the setpoint that allows only a certain amount of kilowatts to be used within a specified time window. When the allowed amount is exceeded, or is predicted to be exceeded, the control strategy starts to turn off power consuming items until the consumption is maintained within the allowed amount. Some schemes use prioritizing selections for shedding and adding loads, and use methods for predicting or forecasting the anticipated need for load shedding. Examples of load shedding control schemes are described in U.S. Pat. Nos. 4,075,699; 4,216,384; 4,337,401; 4,916,328; 5,543,667; 5,414,640; 5,644,173 and 5,598,349.

There is an inherent drawback to these types of strategies. That is, if an apparatus or device is consuming power, it is operational for a reason. For example, in a supermarket, refrigeration is the largest power consumer, consuming about 40% of the supermarket's total electrical usage. When refrigeration is shut off for energy savings, it may be detrimental to the refrigerated product. This type of strategy can affect such things as increased product loss and reduced shelf life. If load shedding is implemented without safeguards, some of these energy saving strategies would hamper the ability to maintain food safety standards.

In this regard, two important considerations for refrigerated storage of food in the supermarket are food safety and "shrink" (product loss due to poorly maintained product). The FDA and the USDA specifies that for certain food products to be safe for public consumption, the supermarket refrigeration must maintain the product's core temperature below 41° F. If for any reason the product's core temperature rises above 41° F., food-borne pathogens begin to grow. Such pathogens include eColi and salmonella. Therefore, the supermarket or cold storage facility must maintain an adequate "cold chain" for food safety reasons.

Although food safety is not a concern until the product's core temperature rises above 41° F., shrink can occur at a much lower temperature. For example, if ice cream rises above 5° F. for a prolonged period of time, its condition deteriorates and it is no longer sellable. Although the ice cream is safe to eat, the supermarket has lost the ability to gain profit from the product sale. Almost every product in the cold chain has a shrink temperature that is far below the food safety temperature, however, both are important to the supermarket owner/operator.

These two concerns have limited the energy engineer's ability to implement an effective load shedding strategy in a supermarket/cold storage facility. As well, in an office environment, increasing temperature setpoints can result in an uncomfortable work environment, thus impacting efficiency and production. Almost without exception, today's control strategies save energy at the cost of a desired condition (cold products, cool or warm offices, extra lighting, etc.).

In the past few years, the electrical power industry has started deregulating in many states. Deregulating electricity will allow consumers to purchase electricity as a commodity on the spot market. Under most of the current deregulation legislative approaches, an end user is given the opportunity to purchase electric power from many legitimate power generating companies willing to supply electric power to the end user's geographic region. The increased competition will ultimately reduce the end user's energy cost. As competition increases, power generators are expected to offer customers various pricing plans, including, for example, plans based on volume and term commitments, and/or on peak/off-peak usage.

It is anticipated that the local distribution company facilities of the local electric utility would continue to be a regulated monopoly within the region it serves. These facilities are primarily the lines and other equipment that constitutes the local power grid over which electric power is delivered to the end user, having been delivered to the grid by generating plants within the local utility service area or by other utilities' grids interfacing with the local utilities grid.

The electric utility primarily relies on meters at customer cites to apprise the utility of how much energy the customer has taken from the local utility's grid. Many of these meters can measure the volume of energy used, the highest volume used during any hour throughout a monthly billing cycle (peak demand), and the volume used in every hour of the monthly billing cycle, or as short a period as every 15 minutes during this cycle. Some meters, such as those used by commercial end users, can measure all of the above. Other meters measure only monthly total electrical usage and peak demand. Meters servicing residential customers often measure only total electrical usage for the month. More sophisticated meters now available enable the local utility to monitor the end user's actual energy usage electronically.

Currently, using these more sophisticated meters, the local utility can continuously monitor the end user's actual energy usage by taking readings every 15 minutes throughout the day. The local utility records that energy usage data and applies its applicable tariff rate to produce a bill for the end user. These tariffs set forth specific rates to be charged to different classes of customers. Some tariffs call for different rates depending on time of use (peak v. off-peak pricing). As deregulation progresses, these same sophisticated meters will allow competing energy providers to offer end users multiple pricing plans and contractual arrangements, such as being configured for time of use, volume and term commitments, etc.

It is anticipated that deregulation will be implemented by power pools or exchanges to make the wholesale market of electricity as a commodity more efficient and to give energy marketers (marketers not affiliated with a local utility) a reasonable chance to compete. The California Public Utilities Commission, for example, has proposed a power exchange to which the three largest in-state electric utilities must sell all their generated power and from which they must buy all the power they need for distribution to their end user customers. Other power generators, utilities, resellers, traders and brokers also buy and sell power through this exchange. In operation, each day the exchange will assess the power supply requirements for the next day for all the end users. The exchange will have power generators, local utilities with generating capacity, resellers and traders submit bids for specified quantities of power to be delivered to the power grid during each hour of the next day. The exchange will then match its assessed needs for power during each hour of the next day starting with the lowest priced power first until it has identified sufficient power supplies for each hour to meet its anticipated demand. The price of the final bid to meet the anticipated demand sets the market price for each hour.

Another system for implementing a commodity spot market system for electric power is described in U.S. Pat. No. 6,047,274. In this system, a "moderator" collects bid information from electricity providers, sorts the bid information according to the rules of an auction, and may further process this bid information, for example, to select electricity providers for particular end users. The provider selection information may include, for example, a prioritization of the providers in accordance with their bids and/or the designation of a selected provider as a default provider. The moderator then transmits selected portions of this information to control computers associated with each end user or group of end users, as well as to participating providers. Each control computer receives the rate information and/or provider selection information from the moderator that pertains to the end user or group of end users with whom the control computer is associated.

From the list of all providers providing bid information to the moderator, each control computer can select one or more providers from whom the participating end user will be provided electric power. The end user can change that selection at any time. After each new bid is submitted by a provider and is processed by the moderator, the rate and/or provider selection data will be transmitted to the relevant control computers and rate information can be distributed to some or all of the providers in order to implement the auction. All providers will then have the opportunity to submit a lower or higher bid for any end user or group of end users to whom they wish to supply electric power. Throughout the bidding process, providers can compete to supply electric power to end users based on available capacity, delivery destinations, volume discounts, peak period requirements, etc. The electric power bids and resulting contracts can be for a preselected kilowatt amount over a preselected unit of time, and number of units of time.

Once a provider has been selected, the moderator of the power exchange can monitor the actual electricity consumed by the user by collecting meter readings. The aforementioned sophisticated meters can transmit usage reports to the moderator every 15 minutes or more or less often. It is anticipated that in the future it will be possible to transmit energy usage in even smaller increments of time than 15 minutes (i.e., near real time). End users can easily make economic choices among competing providers.

Rather than the control computer of each end user selecting the provider with the lowest rate, the moderator can perform this function. The moderator control computer selects the provider's offering the lowest rate at each time block and provides that rate to each end user, i.e., setting or posting the current spot market price.

Other systems for implementing a commodity market for electrical power are disclosed in U.S. Pat. Nos. 5,894,422 and 5,237,507.

The present inventor has recognized that deregulation of electric utilities creates a desirable opportunity for a new load shedding strategy that could take advantage of this new method of buying electricity as a commodity on the spot market.

The present inventor has also recognized that in a deregulated electric utility market it would be desirable for supermarkets and other users of power for refrigeration to implement an effective load shedding (power saving) strategy for refrigeration equipment. The present inventor has recognized the desirability of providing a load shedding strategy for refrigeration equipment which is effective to reduce utility costs while maintaining product quality.

SUMMARY OF THE INVENTION

The present invention relates to a method and apparatus for controlling power consumption of a facility, building or simply a collection of one or more devices, by load shedding when power consumption is above, or is predicted to be above, a power surge setpoint, but only if electrical power on the spot market cannot be purchased at or below a set amount. The apparatus and method of the invention optimizes power usage by taking advantage of the buying of electricity as a commodity on the spot market.

For example, buildings in deregulated markets may negotiate electric power supply contracts for power consumption. The contract will guarantee the building a fixed rate cost for an amount of kWs to be used over a time period, e.g., one month. Energy engineers for the building will first have to determine the amount of power they will use over the month. They will then purchase this power in advance, thus obtaining a favorable kWh rate from a particular utility company. Once a building exceeds its negotiated contract terms, the building can then buy power on the spot market. For example, if a utility customer negotiates a contract that allows 10,000 kWh per hour at 3 cents per kWh, the monthly utility cost will be $30,000. However, if for any reason, such as unexpected hot weather, the building uses 12,000 kWh one month, the building will pay the $30,000 on the negotiated 10,000 kWh, then must purchase the additional 2,000 kWh on the commodity spot market. Using forecasting or predicting techniques during the month based on prior usage profiles, weather forecasting, and current usage, the excess electric power requirement can be predicted or projected. Periodically during the month, electricity can be purchased on the spot market if an excess power requirement is forecast and the spot market price is currently lower than a price setpoint, or, electric consumption can be curtailed by load shedding if the spot market price is unattractively high. If the spot market price is below the price setpoint the additional 2,000 kWh are economically justified based on the beneficial use of the additional power. However, if the spot market price is above the price setpoint the excessive cost of the 2,000 kWh represents a cost that should be avoided, i.e., the cost is not justified by the beneficial use of the excess electricity. The price setpoint is calculated based on economic factors or can simply be the base contract rate.

According to the invention, a controller can continuously monitor the spot market price of electricity and control power consumption and loads based on the spot market price. If spot market price per kWh is high, the controller will then shed loads to maintain as low of power consumption as possible. If the spot market price for electricity is low, the controller will not sacrifice building consumption by load shedding, i.e., the kWh excess will be purchased on the spot market.

Since electrical utility deregulation is only just happening, the method of buying blocks of power and negotiating a power contact is not yet determined. The system of the invention will use a communication link (such as the internet) to access spot market price such as from a power pool moderator, and then, based on current power consumption, decide whether or not to shed loads to limit the excess power required to be purchased on the spot market.

Electrical power can be sold in blocks of time of 15 minutes throughout each day and the spot market price of purchased electricity can be obtained and recorded in the same block of time. Any electrical power usage above a setpoint corresponding to the contract amount for each 15 minute block could be purchased at the spot market price for the particular block of time. The spot market price for each 15 minute block can be determined by bids received by a moderator and made available to the end user, such as described in U.S. Pat. No. 6,047,274, herein incorporated by reference. Alternatively, the pre-negotiated contract could be for an hour, day or month, etc., and the power usage setpoint for each 15 minute block can be forecast based on past power calendar-time usage profiles for a building or facility and on weather forecasting, for example, the setpoint estimated from the total contract power amount for the contract period.

Spot market electricity prices can be monitored, and spot market electricity purchased every 15 minutes, if at an attractive price compared to a preselected price, such as the contract price. To ensure, however, that the end user can satisfy any volume commitment that would likely be part of any attractively-priced supply contract, the moderator could enable the end user to designate from time-to-time the contract provider as the low bidder available to that end user.

As a further aspect of the invention, in the situation of a supermarket for example, which refrigerates food products, artificial product core temperature sensors or direct insertion product sensors can be used to continuously monitor the refrigerated temperature of perishable products. A controller would constantly monitor these temperatures to allow a load shedding routine to be implemented. If for any reason the product temperature begins to rise to the point where product integrity starts to be compromised, a trigger or alarm circuit would cancel the load shedding routine. This direct monitoring of the refrigerated product allows the energy engineer to be more aggressive in load shedding strategies.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
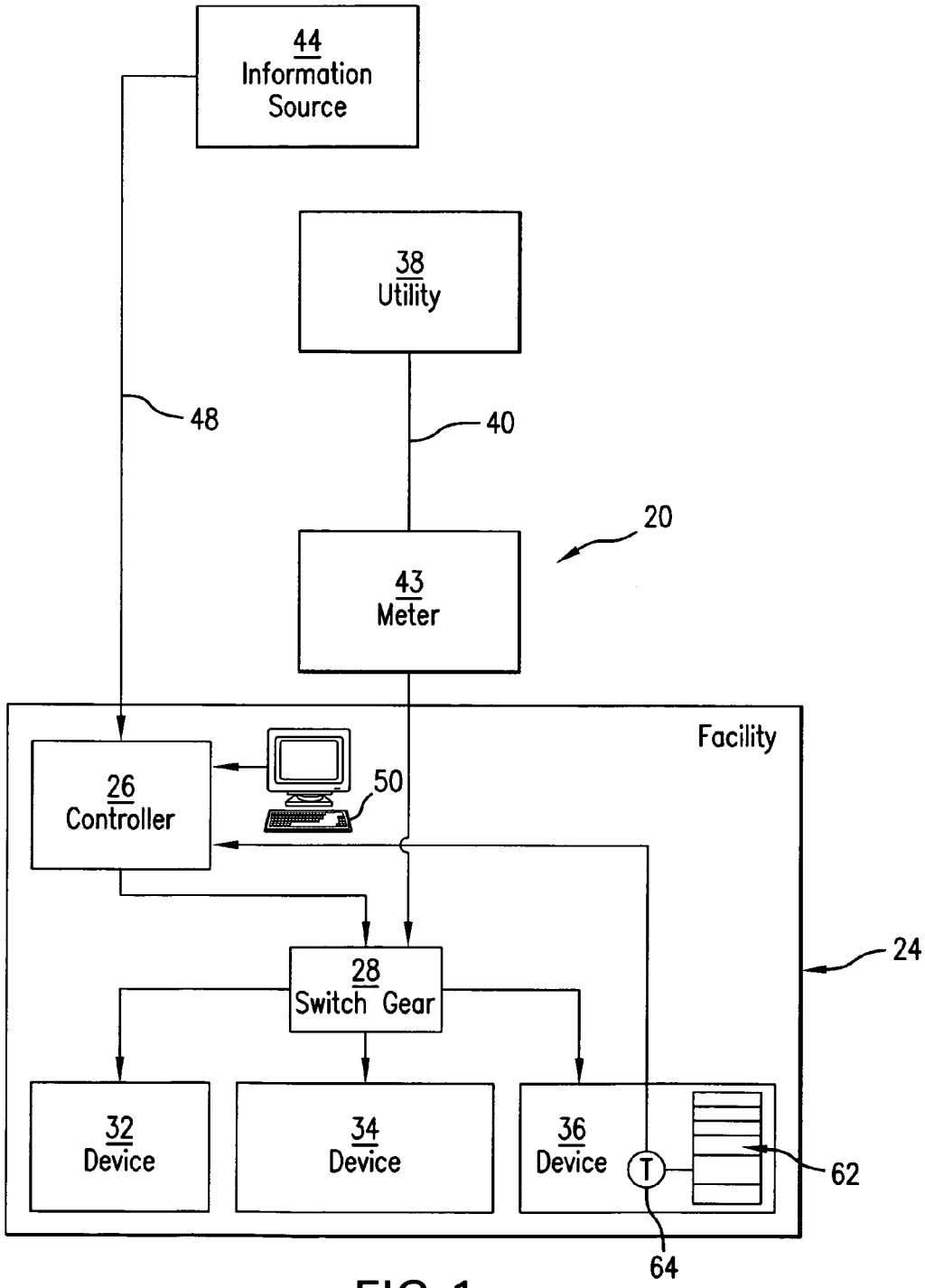
FIG. 1 is a schematical diagram of a power control system of the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a system 20 for controlling power consumption within a facility 24. The facility 24 can be a building, residence, store, warehouse, factory, plant or simply a collection of one or more power consuming devices. The system includes a controller 26 which communicates with a switching network 28 which selectively delivers electrical power to one or more power consuming devices 32, 34, 36 within the facility 24. The power consuming devices can be, for example, refrigerators, fans, lights, or HVAC.

The switching network is fed electrical power from a utility 38 through power lines 40 and a calendar-time power consumption meter 43. The meter 43 has the ability to measure and record and/or transmit power usage per time interval, typically every 15 minutes or lower, as described in U.S. Pat. No. 6,047,274. Although an electrical power distribution system is described, the power commodity could be gas or other fossil fuels, as well.

The controller 26 can also communicate with an outside information source 44, such as an Internet site, or a power pool or exchange moderator, via a communication link 48. The communication link 48 can be comprised of telephone lines, coaxial or fiber optic cable, wireless communication, or other type of signal carrying medium. The controller 26 can also have a manual input, such as a keyboard 50.

The power consuming device 36 can be a refrigeration unit for storing food products 62. The system 20 can include a temperature sensor 64 which is in signal communication with the controller 26. The sensor 64 can be a direct insertion sensor or a food product core sensor such as described in U.S. Pat. Nos. 6,018,956; 4,184,340; or 3,343,151, herein incorporated by reference. These patents describe temperature sensors that are surrounded by material, other than air, which material simulates the time-temperature constant of the product being refrigerated. The sensor more accurately measures the temperature of the product core that is slowly being warmed during load shedding.

Figure 2:
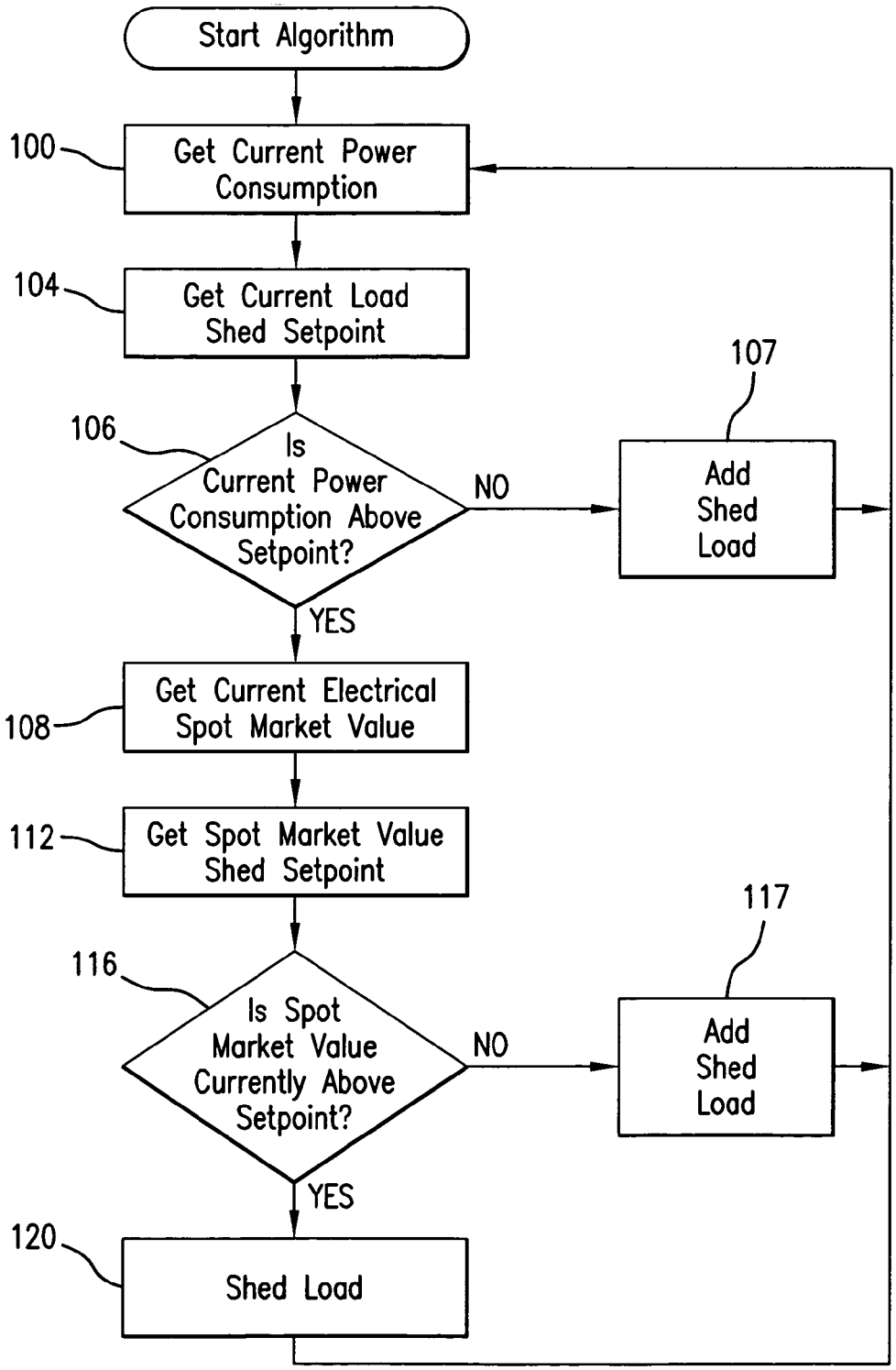
FIG. 2 is a block diagram of a first method of the present invention.

A first method of the invention is described in block flow diagram, FIG. 2. In a first step 100, the power consumption is monitored by the controller 26 for the facility 24. It is foreseen that power will be sold by contract blocks which are negotiated in advance. The blocks would advantageously be 15 minutes in length, and would be for a KW power value. Any power used by the buyer (end user) over and above a power usage setpoint for each of the blocks would be sold to the buyer at a commodity rate or spot market rate by the utility. This spot market rate can fluctuate. The spot market rate can be more or less than the contractual rate for the same time period.

In a step 104 the power usage setpoint is obtained. The setpoint can be input as the contract amount for the electrical power for the block or can be a varying setpoint which is calculated based on the total contract amount over a longer period of time, or can be input periodically by an operator. In a step 106, the current power consumption is compared to the setpoint. If power consumption is below the setpoint, the algorithm is reset, that is, loads previously shed are added back online in step 107, or non-shed status is continued. If the current power consumption is above the setpoint, the current spot market value of electrical power is obtained in a step 108. The spot market price can be acquired by the controller automatically via the link 48 or can be manually input by an operator via the keyboard 50.

A preselected or calculated market value price setpoint is obtained in a step 112. This market value price setpoint can be input daily or otherwise periodically, or can be calculated by the controller based on input economic factors. The market value price setpoint can correspond to the contract price or rate. In a step 116, the spot market price of electrical power is compared to the price setpoint. If the spot market price is above the price setpoint, the algorithm begins to shed loads, step 120, to reduce electric power consumption. If the spot market price is not above the price setpoint the algorithm resets, that is, loads previously shed are added back online in step 117, or non-shed status is continued.

If the spot market price for electricity is advantageously low, such as lower than the pre-negotiated contract price for electricity, the building or other end user may continue to buy electricity at no reduction in power consumption rate. If, on the other hand, the spot market rate for electricity is disadvantageously high, such as being higher than the pre-negotiated contract price for electricity, the end user may decide to reduce or eliminate the amount of excess electricity required to be purchased on the spot market.

The controller can be configured to monitor the power consumption per time block to project power consumption for the contracted period which may be a short period (such as 15 minutes) or a long period (such as one month). Examples of systems for computing this power consumption can be found in U.S. Pat. Nos. 4,075,699; 5,543,667; 4,916,328 and 5,414,640.

According to a further development of the invention, the algorithm of the controller will continuously monitor the spot market price being set by the commodity market and then shed electrical loads in the building or buildings, or other facility based on single or multiple setpoints. The algorithm of the controller can be implemented within an existing building or facility control system or can be added to a new controller being installed in the building or facility for this purpose only. This algorithm can effect multiple loads and have multiple steps of load shedding. The actual strategy of which devices are turned off or shed to save energy will vary, based on the building or facility being controlled. For example, in an office building, the heating and air conditioning consumes the most power and would probably be the target of a load shedding strategy. However, in a supermarket, the refrigeration system is the major power consumer and thus would be the target of any load shedding strategy.

Examples of load shedding procedures including load priorities or tiers are described in U.S. Pat. Nos. 5,598,349; 5,644,173; 4,337,401; 4,216,384; 4,916,328; 5,543,667 and 4,075,699.

Recently, a new product has been commercialized in the retail supermarket industry: artificial product core temperature sensors and direct insertion product sensors. These sensors have been installed for controlling shrink and increasing food safety and meeting new FDA and USDA codes. The present inventor has recognized that these sensors could be effectively used to control power consumption associated with refrigeration.

When the end user is a supermarket, cold storage facility or other facility which refrigerates food products, the algorithm of the controller would constantly monitor the product core sensor or direct insertion product sensor to ensure that the food product temperature does not exceed a preselected setpoint at which food integrity is compromised. If for any reason the food product temperature exceeds the predetermined setpoint, a trigger and alarm would cancel the load shedding routine.

Figure 3:
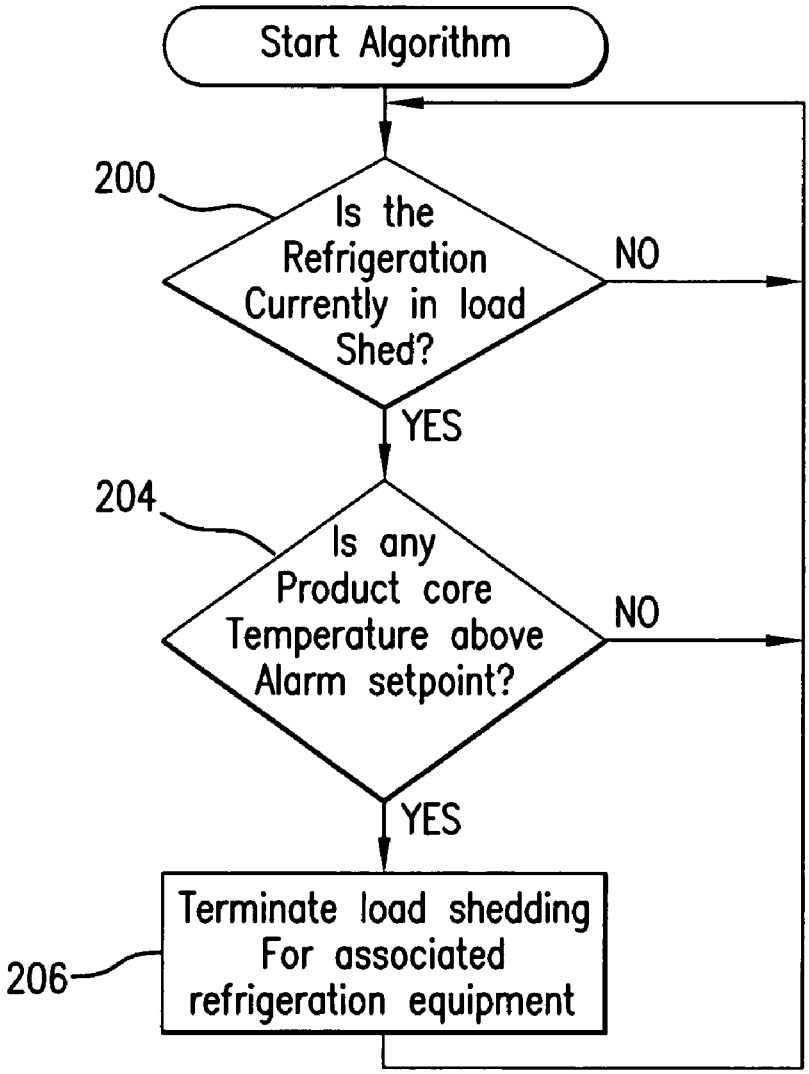
FIG. 3 is a block diagram of a second method of the present invention.

FIG. 3 illustrates this second method of the invention. According to this method, a power consumption routine allows load shedding of refrigeration equipment 36 only to a point at which the sensor 64 indicates that food products 62 have reached a temperature limit beyond which food product integrity may be compromised. At that point the controller allows power to the apparatus 36 as demanded by the refrigeration control circuitry, by signal from a thermostat.

In the step 200, the algorithm checks to determine whether a load shed condition exists. If the system is in a load shed mode, that is, economics of power consumption dictate that the refrigeration system be turned off, step 204 checks the product core temperature. If the system is not in load shed, the algorithm resets. If the product core temperature is above a maximum temperature setpoint or alarm setpoint, in a step 206, the load shedding command for the refrigeration apparatus 36 is overruled and load shedding is terminated, and the algorithm resets.

Figure 4:
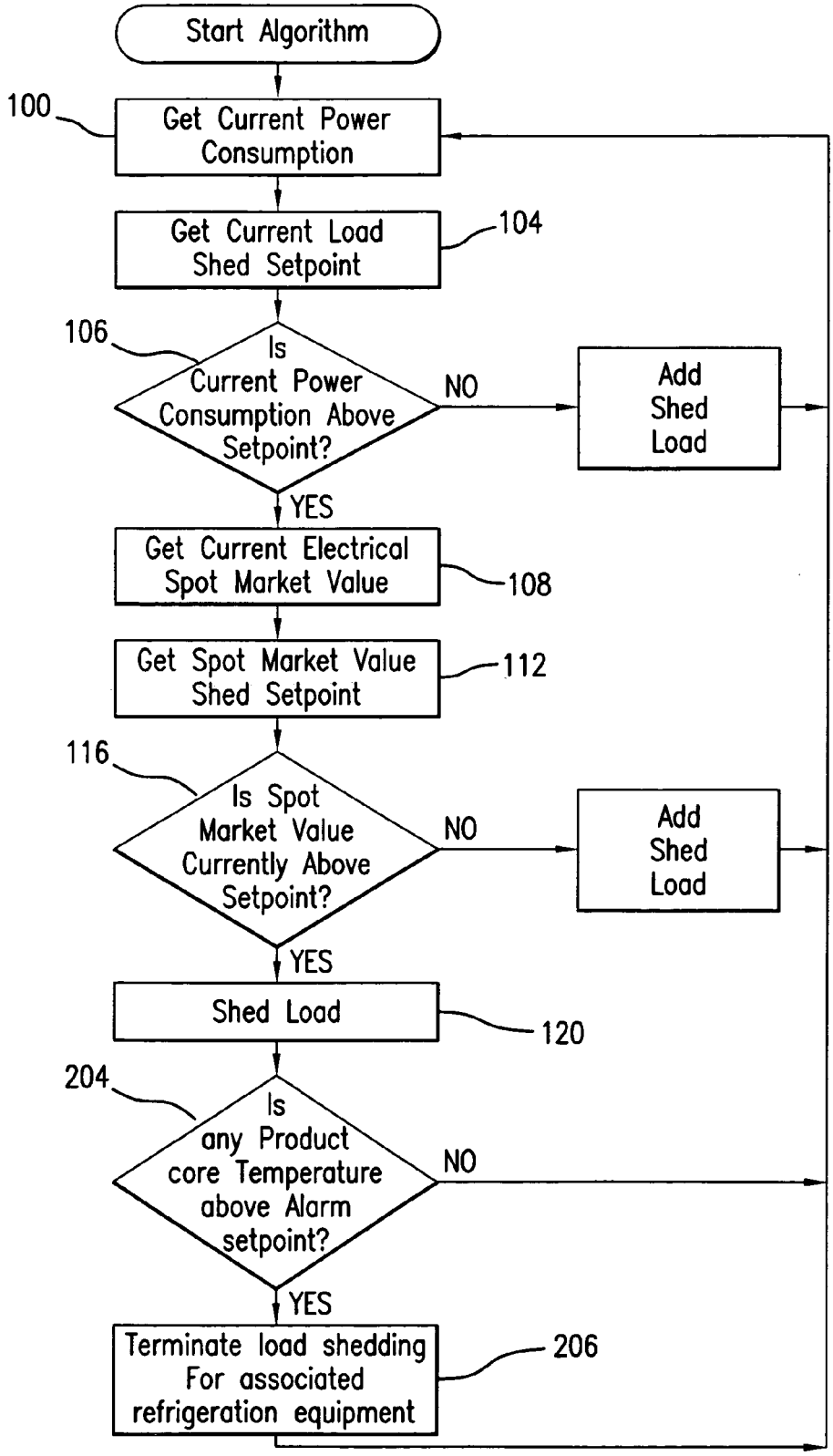
FIG. 4 is a block diagram of a third method of the present invention.

The method which incorporates both the routine of FIG. 2 and of FIG. 3 is demonstrated in FIG. 4. This method is a combination of the methods illustrated in FIGS. 2 and 3. According to this method load shedding of a refrigeration apparatus can occur if the power consumption setpoint is exceeded, step 106, and if the spot market price is higher than the target price, step 116. However, if the product temperature rises above the temperature setpoint, step 204, the load shedding of the refrigeration unit is terminated, step 206, i.e., the refrigeration unit is turned back on.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A method of power consumption control, comprising the steps of:

setting a power consumption per time period setpoint;

determining the current price of power per unit time period;

monitoring power consumption of a plurality of devices; and controlling said power consumption when said power consumption exceeds said setpoint based on current price, whereby if the current price is below a set amount, maintaining power consumption, and if the current price is above the set amount, reducing power consumption of at least one preselected device of said plurality of devices.

2. The method according to claim 1, wherein the step of determining the current price of power is further defined in that spot market prices are continuously monitored by a controller via a communication link, and said current price of power per unit time period is defined by the spot market price.

3. The method according to claim 2, wherein said preselected device comprises a refrigeration apparatus, and comprising the further step of monitoring temperature of a refrigerated product and if the temperature of the refrigerated product exceeds a predetermined temperature, resuming power consumption of said refrigeration apparatus.

4. The method according to claim 1, wherein said power is in the form of electrical power.

5. The method according to claim 1, wherein said set amount is predetermined by a user.

6. The method according to claim 1, wherein said power consumption per time period setpoint is predetermined by a user.

7. The method according to claim 1, wherein the step of determining the current price of power is further defined in that a spot market price is set by a moderator as the current price.

8. A system for load shedding power, comprising:

a switch connected to a source of electrical power;

a power consuming apparatus connected to said switch;

a control connected to said switch to adjust power flow to said apparatus;

a communication link arranged to allow communication between said control and a remote information supplier, the remote information supplier providing as a signal, the current market price of electrical power;

said control comprising a control circuit within said control which contains a preselected power consumption setpoint, and wherein said control circuit controls said power consumption when said power consumption exceeds said setpoint based on current price, whereby if the current price is below a set amount, power consumption is maintained, and if the current price is above the set amount, power consumption of at least one preselected device of said plurality of devices is reduced.

9. The system according to claim 8, wherein said power consuming apparatus conditions a space and further comprising a sensor that responds to condition within said space, said sensor signal-connected to said control, said control switching on said electrical power to said power consuming apparatus in response to said sensor if said condition within said space reaches a predetermined condition setpoint.

10. The system according to claim 9, wherein said power consuming apparatus comprises a refrigeration unit and said condition is temperature.

11. The system according to claim 10, wherein said sensor comprises an artificial product core temperature sensor.

12. The system according to claim 10, wherein said sensor comprises a direct insertion product sensor.

* * * * *